US007275755B2

(12) United States Patent
Marion

(10) Patent No.: US 7,275,755 B2
(45) Date of Patent: Oct. 2, 2007

(54) GLIDING OR ROLLING BOARD

(75) Inventor: Thierry Marion, Duingt (FR)

(73) Assignee: Salomon S.A., Metz-Tessy (FR)

( * ) Notice: Subject to any disclaimer, the term of this patent is extended or adjusted under 35 U.S.C. 154(b) by 137 days.

(21) Appl. No.: 10/737,892

(22) Filed: Dec. 18, 2003

(65) Prior Publication Data

US 2004/0135347 A1 Jul. 15, 2004

(30) Foreign Application Priority Data

Dec. 19, 2002 (FR) ..... 02 16732

(51) Int. Cl.
*A63C 5/07* (2006.01)

(52) U.S. Cl. ..... 280/602; 280/610; 280/14.21

(58) Field of Classification Search ..... None
See application file for complete search history.

(56) References Cited

U.S. PATENT DOCUMENTS 3,844,576 A * 10/1974 Schultes ..... 280/610
4,383,701 A * 5/1983 Hirnbock et al. ..... 280/610
5,064,214 A * 11/1991 Diard et al. ..... 280/607
5,501,825 A * 3/1996 Jodelet ..... 264/46.5
RE36,453 E * 12/1999 Abondance et al. ..... 280/609
6,059,308 A 5/2000 Baudin et al. ..... 280/610
6,113,126 A * 9/2000 Zanco et al. ..... 280/610
6,237,932 B1 5/2001 Zanco et al. ..... 280/602
6,502,850 B1 * 1/2003 Schaller et al. ..... 280/610
6,851,699 B2 * 2/2005 DeRocco ..... 280/602

FOREIGN PATENT DOCUMENTS

| | | |
|---|---|---|
| DE | 3441996 | 6/1985 |
| EP | 0798021 | 10/1997 |
| EP | 0966992 | 12/1999 |
| FR | 2780295 | 12/1999 |

* cited by examiner

*Primary Examiner*—Christopher Bottorff
(74) *Attorney, Agent, or Firm*—Greenblum & Bernstein, P.L.C.

(57) ABSTRACT

A gliding or rolling board having, in height, a first reinforcement and a second reinforcement between which a first core is arranged. Along at least a portion of the periphery of the board, a band having a shock-absorbing material is juxtaposed to a reinforcement.

46 Claims, 4 Drawing Sheets

GLIDING OR ROLLING BOARD

CROSS-REFERENCE TO RELATED APPLICATION

This application is based upon French Patent Application No. 02.16732, filed Dec. 19, 2002, the disclosure of which is hereby incorporated by reference thereto in its entirety and the priority of which is hereby claimed under 35 U.S.C. §119.

BACKGROUND OF THE INVENTION

1. Field of the Invention

The invention relates to the field of gliding boards adapted to snowboarding, water surfing, snow skiing, water skiing, skateboarding, and the like.

2. Description of Background and Relevant Information

A gliding board, according to prior art, has a length measured along a longitudinal direction between a first end and a second end, a width measured along a transverse direction between a first edge and a second edge, and a height measured between a gliding or rolling surface and a supporting surface.

From the first end to the second end the board has a first end zone, a central zone, and a second end zone.

Within a first family of boards, each board has a sandwich structure, formed by a first reinforcement and a second reinforcement, between which a first core is positioned. In the area of the edges, a spacer that is as thick as the core joins the reinforcements together. The spacer protects the core from shocks and infiltrations, particularly water.

Each spacer weighs down the board and at least partially absorbs vibration forces originating in the area of an edge during the steering of the board, since it prevents a direct transmission of the forces. This is particularly the case in snowboarding. Thus, a board from the first family is generally stable and flexible in steering.

Within a second family of boards, each board has a first reinforcement and a second reinforcement between which a first core is positioned. In the area of the edges, the reinforcements are joined directly to form an envelope around the core.

The direct junction of the reinforcements lightens the board and allows for a direct transmission of the forces related to the steering of the board. This is particularly the case in snowboarding, as transverse forces are received, where a force exerted in the area of an edge is transmitted directly between the gliding and receiving surfaces. Thus, a board of the second family is generally reactive in that it accurately transmits the forces related to steering.

SUMMARY OF THE INVENTION

An object of the invention in particular is a board that combines the respective advantages of the boards of the aforementioned two families.

More specifically, one of the objects of the invention is to make a board that is capable of absorbing vibrations, that is light, and that is capable of accurately transmitting the forces related to steering.

To this end, the invention proposes a gliding or rolling board having a length measured along a longitudinal direction between a first end and a second end of the board, a width measured along a transverse direction between a first edge and a second edge, and a height measured between a gliding surface and a support surface, the board having, in height, a first reinforcement and a second reinforcement between which a first core is positioned, the board further having, from the first end to the second end, a first end zone, a central zone, and a second end zone.

Along at least a portion of the periphery of the board, the board according to the invention has a band that includes a shock-absorbing material juxtaposed to a reinforcement.

The band can be inserted between the reinforcements. In that case, the shock-absorbing band separates the reinforcements in the area of the peripheral portion.

The band allows for an absorption of vibrations since the reinforcements are not connected directly together where the band is extended.

The band enables the board to remain a light structure. Indeed, its limited thickness has an influence with little or no substantial significance on the weight of the board.

By its reduced thickness, the band also allows an accurate transmission of forces related to steering.

In fact, the band acts like a filter that absorbs interfering vibrations and allows the transmission of forces related to steering.

BRIEF DESCRIPTION OF DRAWINGS

Other features and advantages of the invention will be better understood by means of the following description, with reference to the attached drawing showing, through non-limiting examples, how the invention can be embodied, and in which.

DETAILED DESCRIPTION OF THE INVENTION

Even though the various embodiments to which reference will be made in the following description relate to a snowboard, it is to be understood that the invention relates to other boards adapted to sporting activities, such as those mentioned previously.

The first embodiment is described hereinafter with reference to FIGS. 1-4.

Figure 1:
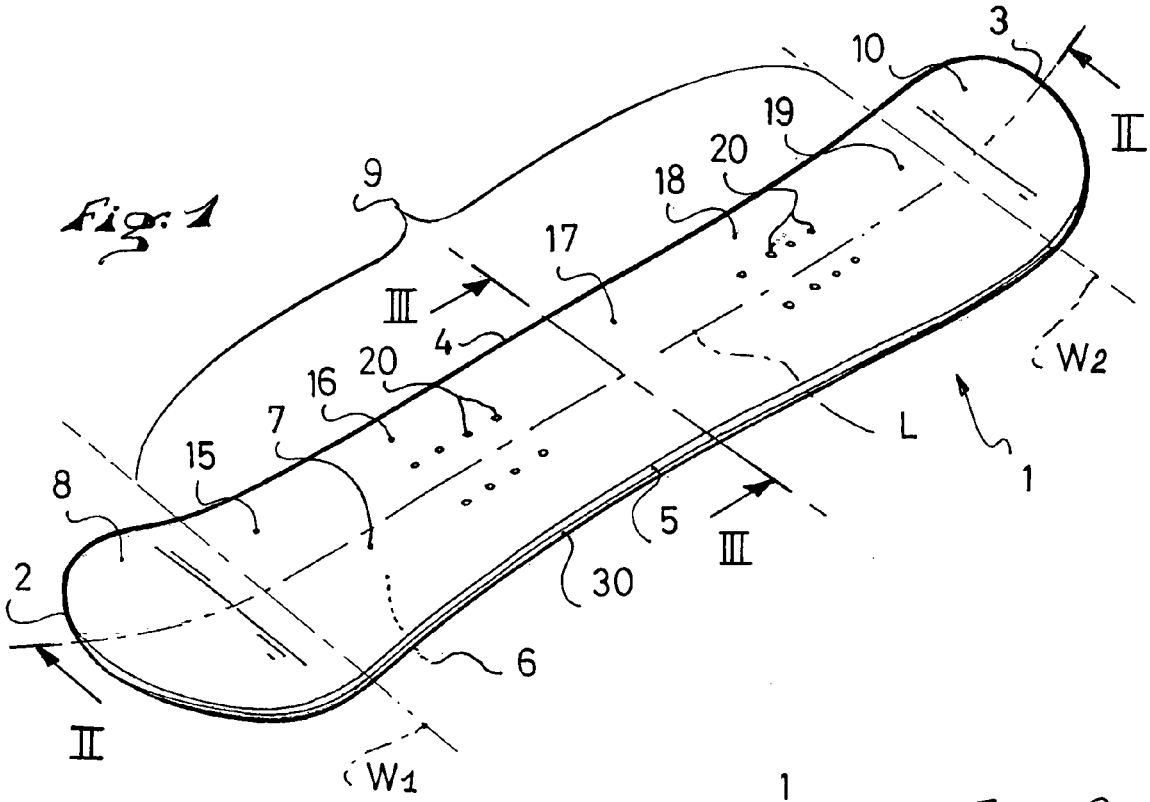
FIG. 1 is a perspective view of a shell-type board according to a first embodiment of the invention.

As known and as seen particularly in FIG. 1, a snowboard 1 has a length measured along a longitudinal direction "L" between a first end 2 and a second end 3. The board 1 also has a width measured along a transverse direction between a first lateral edge 4 and a second lateral edge 5, as well as a height measured between a gliding surface 6 and a receiving surface 7.

The transverse direction is perpendicular to the longitudinal direction "L" and parallel to the gliding surface 6.

From the first end 2 to the second end 3, the board 1 also has a first end zone 8, a first contact line W1, a central zone 9, a second contact line W2, and a second end zone 10. The central zone 9 itself successively has, between the contact lines W1, W2, a first intermediary zone 15, a first retaining zone 16, a second intermediary zone 17, a second retaining zone 18, and a third intermediary zone 19.

Each retaining zone 16, 18 is provided to receive a device for retaining the user's foot. The devices, not shown, can be affixed to the board 1 by a means, such as screws. To this end, each retaining zone 16, 18 is provided with threaded orifices 20.

Each of the contact lines W1, W2 is a line substantially transverse to the board 1, in the area of which the gliding surface 6 touches a planar surface when the board 1 rests on the surface without any outside influence.

Figure 2:
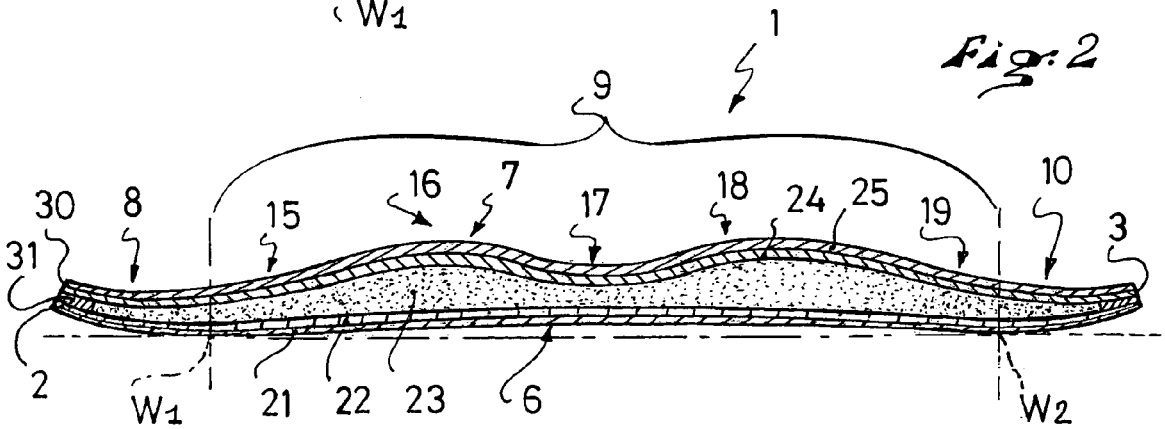
FIG. 2 is a cross-section along the line II-II of FIG. 1.
Figure 3:
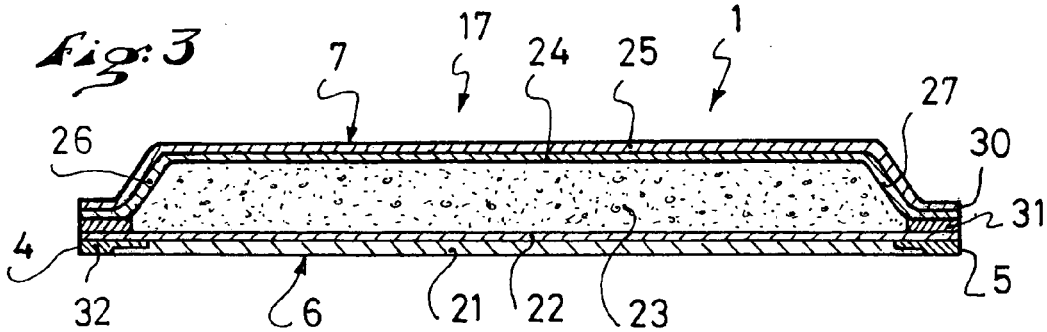
FIG. 3 is a cross-section along the line III-III of FIG. 1.

The height of the board 1 is seen in cross-section in FIGS. 2 and 3.

From the gliding surface 6 to the receiving surface 7, the board 1 has a sole 21, a first reinforcement 22, a core 23, a second reinforcement 24, and a protective layer 25.

The sole 21 is manufactured, for example, with a plastic material containing polyethylene. The protective layer 25 is manufactured, for example, with a plastic material containing an acetyl-butadiene-styrene.

Each of the reinforcements 22, 24 is preferably made from resin-impregnated fibers. The fibers can be made with any material, or with a mixture of materials, such as glass, carbon, aramid, metal, or other. The core 23 includes a low density material, such as wood or a foam made of synthetic material, which gives it a reduced mass. The simultaneous use of wood and of foam is also possible.

The reinforcements 22, 24 and the core 23 form a structure that extends along at least 50% of the length of the board and, in a preferred embodiment, substantially along the entire length. This makes the structure of the board homogenous.

As seen clearly in the cross-secrional view of FIG. 2, taken along a vertical longitudinal median plane, the thickness of the board varies between the first end 2 and the second end 3. The variation in thickness of the board 1 is mainly due to the variation in thickness of the core 23, since the reinforcements 22, 24, the sole 21, and the protective layer 25 have a substantially constant thickness.

The structure of the core 23 gives minimal thicknesses to the end zones 8, 10, maximum thicknesses to the retaining zones 16, 18, and intermediary thicknesses to the intermediary zones 15, 17, 19. Thus, when seen in profile, the core 23 and consequently the board 1 have two projecting bosses on the side of the receiving surface 7.

As an example, the thickness of the core is approximately 1.0-5.0 millimeters in an end zone, 2.0-12.0 millimeters in an intermediary zone 15, 17, 19, and 5.0-15.0 millimeters in a retaining zone 16, 18. These values are given as exemplary and relate particularly to the field of snowboards. Any other ranges of values, as well as other profiles, could also be used within the scope of the invention.

In a complementary manner, the thickness of the core 23 varies continuously between the ends 2, 3 of the board 1. However, interrupted variations in thickness could be provided.

In a complementary but non-obligatory manner, as seen in cross-sectional view of FIG. 3, taken along a vetical transverse median plane, the second reinforcement 24 has first 26 and second 27 inclined edges. These edges 26, 27 give the reinforcement 24 a recessed form on the side of the core 23. The assembly of the reinforcements 22, 24 gives the board 1 a shell-type structure.

According to the invention, along at least a portion of the periphery 30 of the board 1, a band 31 having a shock absorbing material is inserted between the reinforcements 22, 24, the band 31 having a thickness less than or equal to 50% of the maximum thickness of the core 23. The band 31 connects the reinforcements 22, 24 along at least a portion of the periphery 30 of the board 1.

The first 2 and second 3 ends, as well as the first 4 and second 5 edges of the board 1, are part of the periphery 30.

Figure 4:
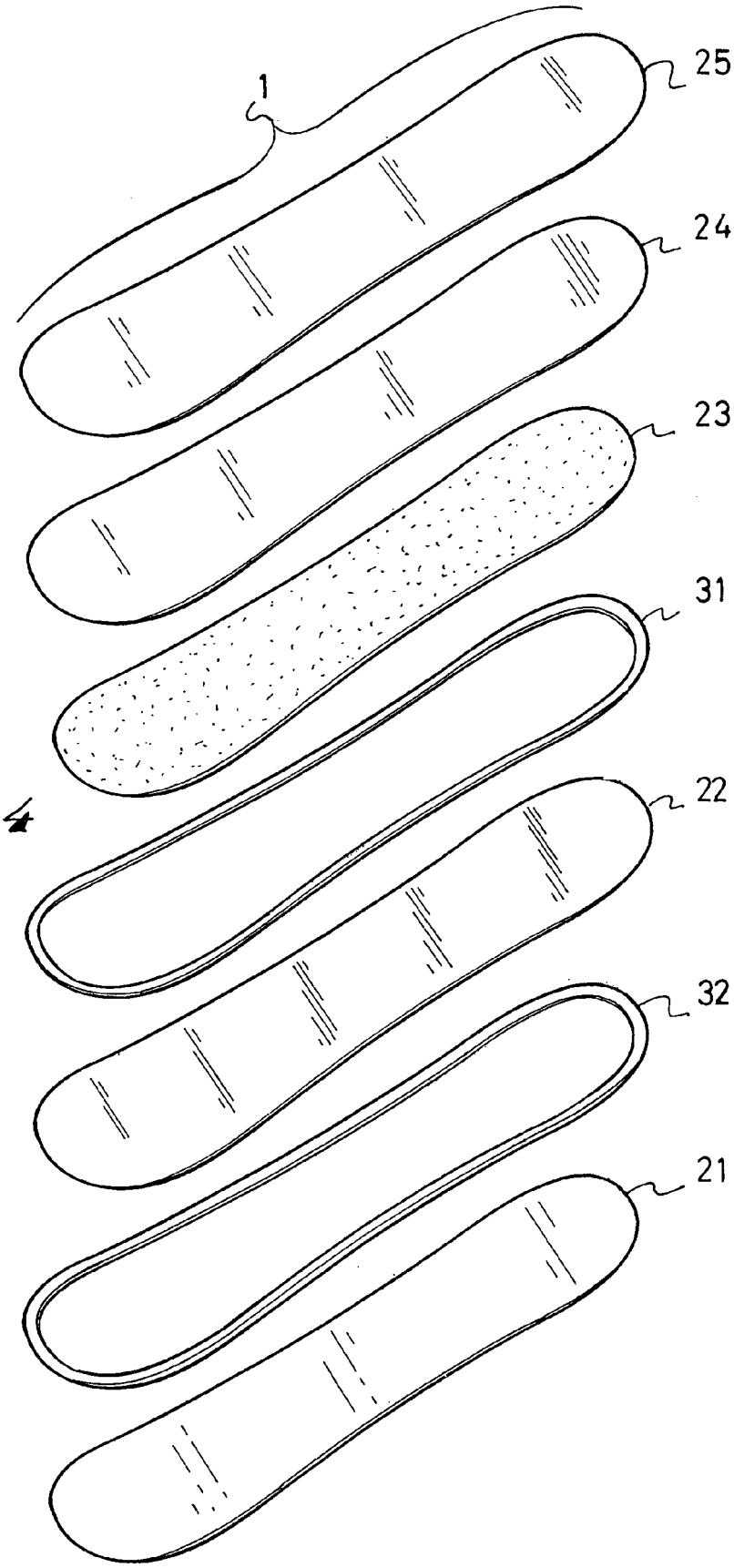
FIG. 4 is an exploded perspective view of the board according to FIG. 1.

According to the first embodiment of the invention, as seen clearly in FIG. 4, the band 31 extends continuously in the area of the periphery 30 of the board 1. The band 31 is a peripheral joint that connects the reinforcements 22, 24 along the entire periphery 30.

Given that the thickness of the band 31 is reduced with respect to that of the core, impulses related to the steering pass through substantially directly from one reinforcement to the other. This is particularly the case in snowboarding during transverse contacts in the area of one of the lateral edges 4, 5. However, the presence of the band 31 allows for a shock absorption of the interfering vibrations. This is particularly the case in a curve, in the area of the end zones 8, 10. The shock-absorbing band 31 prevents, or at least substantially reduces, a vibration of the ends 2, 3 of the board 1. Consequently, the board 1 stays in better contact with the terrain.

The band 31 is shown in the form of a continuous element, i.e., without joints or abutting of two ends. A continuous element is manufactured easily and directly by a reduced number of operations. Nevertheless, it could be provided to make a joint on a sectioned element, for example, by gluing, welding, splicing, or any other means.

As seen better in FIGS. 2 and 3, the cross-sectional profile of the band 31, in a particular embodiment, is rectangular. This facilitates the positioning of the band in the structure of the board 1. Alternatively, other sectional shapes could be used, namely those of a square, a trapezium, a polygon, or other shape.

The thickness of the band 31, measured in the direction of the height of the board 1, is between 0.2 millimeters and 5 millimeters, for example. A more preferred range of values of the thickness is between 1.0 mm and 3 mm.

In the first embodiment of the invention, the thickness of the band 31 is substantially constant. This gives the board 1 a homogeneity in behavior during steering. However, the thickness of the band 31 could be provided to vary along the periphery 30. For example, the thickness of the band 31 can be slightly more substantial from one retaining zone 16, 18 to the other. In this case, the board can absorb the impulses more in the area of the lateral edges 4, 5.

The width of the band 31, measured in parallel with the first reinforcement 22, is approximate to the width of a peripheral running edge 32 of the board 1. The width of the band 31 is therefore several millimeters, for example, between 2 mm and 25 mm. Preferred values of the width are between 3 mm and 15 mm. Nevertheless, the width of the band 31 could be provided to be less than or, on the contrary, greater than that of the running edge 32.

In the first embodiment of the invention, the width of the band 31 is substantially constant. This makes the behavior of the board 1 homogenous. However, the width can be provided to vary from one area to the other of the board. For example, the width of the band 31 can be reduced in the area of one of the lateral edges 4, 5, and more substantial in the area of the other edge 4, 5. This allows differentiating the shock absorption for transverse forces imposed upon the area of the lateral edges 4, 5.

The band 31 can be made from various materials, such as a plastic or a synthetic material, a natural or a synthetic rubber, an agglomerated cork, or other.

The constitutive material of the band 31 is selected so that its hardness is between 10 shore D and 60 shore D, from the softest to the hardest.

For example, an acetyl-butadiene-styrene having a hardness approximately 60 shore D, allows making a shock-absorbing band 31 that is relatively hard. This band nevertheless allows absorbing certain shocks and vibrations, because the band 31 is softer than the reinforcements 22, 24 or the running edge 32. A board made with this band is well suited for performing acrobatic maneuvers.

By using a rubber having a hardness approximate to 10 shore D, the shock-absorbing band 31 is much more flexible. This band absorbs the shocks and vibrations for a wide range of frequencies. A board made with this band is well suited for steering in curves and for slalom.

The manufacture of the board 1 is explained with reference to FIG. 4.

Each constitutive element of the board 1 is made separately at the beginning of the manufacturing process, according to any technique known to one skilled in the art. In particular, the band 31 can be made by cutting a sheet, the cut out being made by a cutting tool with a blade, by an ultrasonic device, by water jet, by laser, or by any other technique.

A laminated stack, including at least the sole 21, the first reinforcement 22, the shock-absorbing band 31, and the core 23, as well as the second reinforcement 24 and the protective layer 25, is arranged in a mold. The running edge 32 may or may not be arranged in the mold with the other elements. Next, a rise in temperature and pressure affixes the elements together to form the board 1.

Other embodiments of the invention are described hereinafter. For reasons of convenience, it is primarily their specific characteristics with respect to the first embodiment that are shown.

Figure 5:
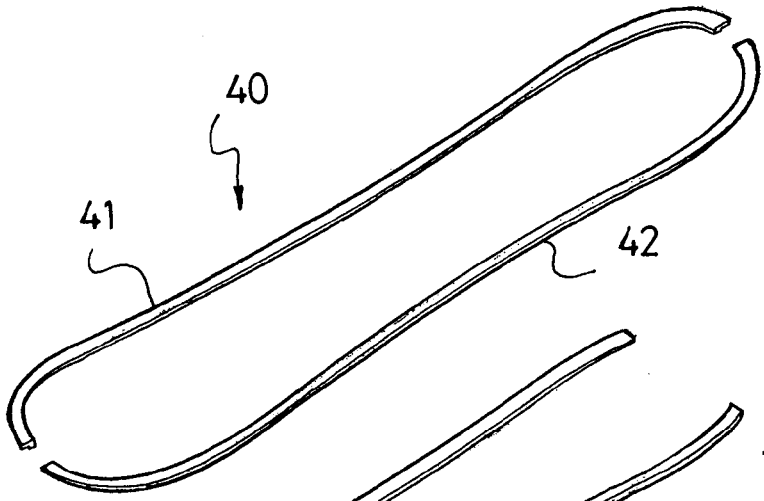
FIG. 5 is a perspective view of a segmented band of a board according to a second embodiment of the invention.

The second embodiment is described with reference to FIG. 5.

A band 40, having a shock-absorbing material in the context of the invention, has a first lateral portion 41 and a second lateral portion 42. The portions 41, 42 extend from a first to a second end of the board. A band 40, fragmented into several portions, according to the second embodiment, allows savings on production material. Indeed, in a same sheet of material, the cut outs are very close together, since they can be made in the same direction. After assembling the board, the portions 41, 42 may or may not be joined.

Figure 6:
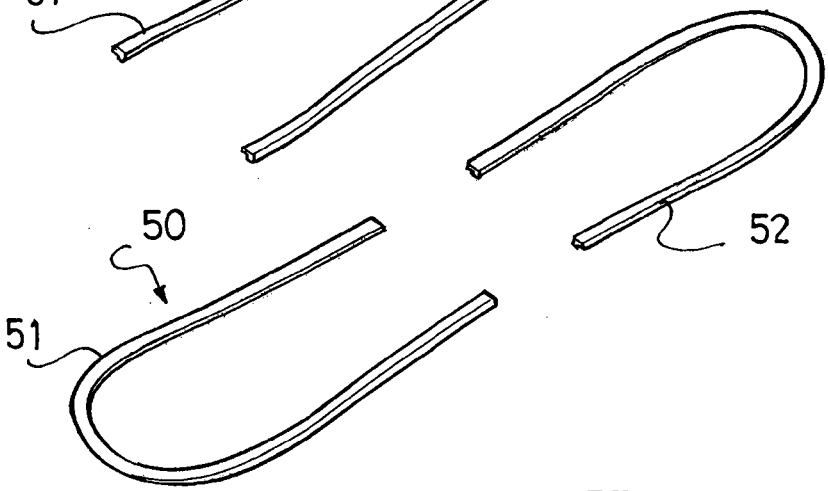
FIG. 6 is a perspective view of a segmented band of a board according to a third embodiment of the invention.

The third embodiment is described with reference to FIG. 6.

A band 50, having a shock-absorbing material in the context of the invention, has a first end portion 51 and a second end portion 52. Preferably, each end portion 51, 52 has a symmetrical form in the plane of the board, on both sides of a central longitudinal axis of the board. Each end portion extends, for example, from one retaining zone to one end of the board. Consequently, only the intermediary zone between the retaining zones is not crossed through by a portion of the band 50. The board according to the third embodiment promotes the absorption of the vibrations toward the ends of the board.

Figure 7:
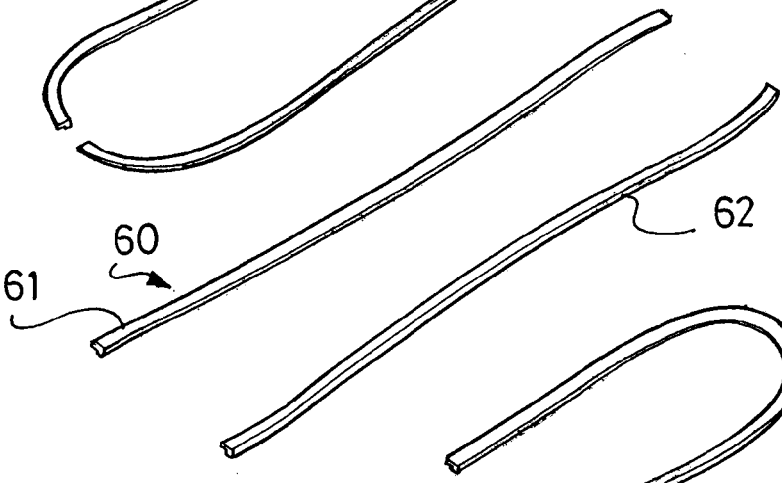
FIG. 7 is a perspective view of a segmented band of a board according to a fourth embodiment of the invention.

The fourth embodiment is described with reference to FIG. 7.

A band 60, having a shock-absorbing material in the context of the invention, has a first lateral portion 61 and a second lateral portion 62. Preferably, the portions 61, 62 are symmetrical one with respect to the other in the plane of the board, on both sides of a central longitudinal axis of the board. Each portion extends, for example, from one contact line to the other. The board according to the fourth embodiment promotes the absorption of vibrations between the ends of the board.

Figure 8:
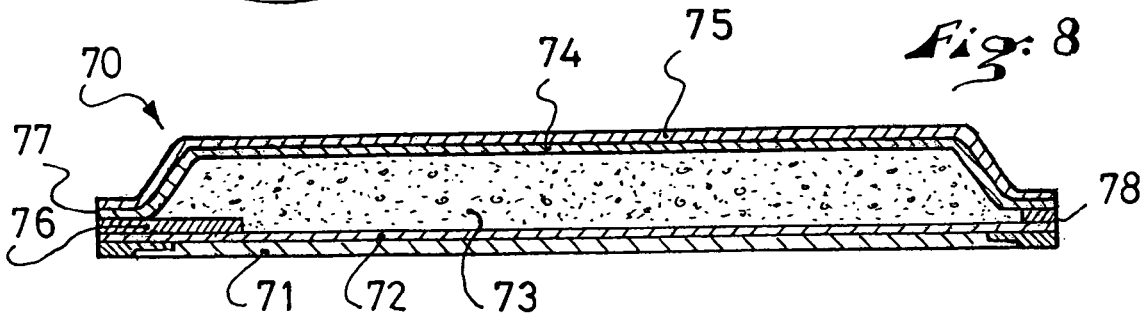
FIG. 8 is a transverse cross-sectional view of a board according to a fifth embodiment of the invention.

The fifth embodiment is described with reference to FIG. 8.

A board 70 has, in height, a sole 71, a first reinforcement 72, a core 73, a second reinforcement 74, and a protective layer 75. A shock-absorbing band 76 is positioned between the reinforcements 72, 74 at the periphery of the board 70. According to the fifth embodiment, the shock-absorbing band 76 is relatively wide in the area of a first lateral edge 77, and relatively narrow in the area of a second lateral edge 78. As a result, despite the same thickness toward each of the lateral edges 77, 78, the absorption of the vibrations and of the impulses is distinguished transversely.

Figure 9:
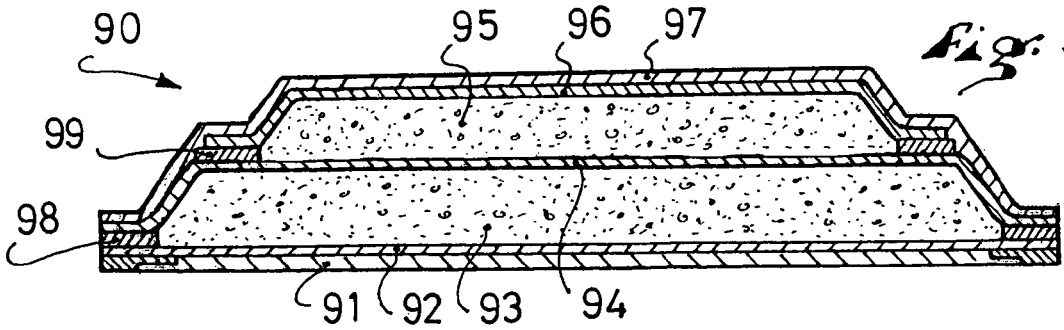
FIG. 9 is a transverse cross-sectional view of a board according to a sixth embodiment of the invention.

The sixth embodiment is described with reference to FIG. 9.

A board 90 has, in height, a sole 91, a first reinforcement 92, a first core 93, a second reinforcement 94, a second core 95, a third reinforcement 96, and a protective layer 97. A first shock-absorbing band 98 is positioned between the first 92 and second 94 reinforcements at the periphery of the board 90. A second shock-absorbing band 99 is positioned between the second 94 and third 96 reinforcements at the periphery of the board 90, or at the periphery of the second core 95. According to the sixth embodiment, the board 90 has at least one raised zone with a shock-absorbing band 99 between the second 94 and third 96 reinforcements. A shock-absorbing band can be provided only between the first 92 and second 94 reinforcements, or only between the second 94 and third 96 reinforcements. Preferably, the portions of the board 90 that have a first 93 and a second 95 core are the retaining zones. This spaces the boots from the ground, which advantageously minimizes the friction of the boots on the ground.

Figure 10:
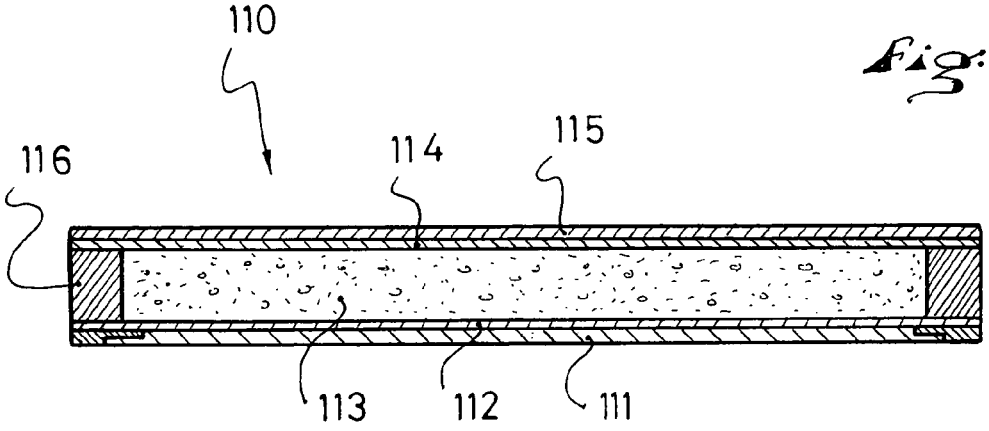
FIG. 10 is a cross-section similar to that of FIG. 8 for a sandwich-type board, according to a seventh embodiment of the invention.

The seventh embodiment is described with reference to FIG. 10.

A board 110 has, in height, a sole 111, a first reinforcement 112, a first core 113, a second reinforcement 114, and a protective layer 115. A shock-absorbing band 116 is positioned between the reinforcements 112, 114 at the periphery of the board 110. According to the seventh embodiment, the shock-absorbing band 116 has a height that is substantially identical to that of the core 113 or, as shown in FIG. 10, a height that is identical to that of the core 113, particularly at the lateral edges of the core. The second reinforcement 114 covers both the core 113 and the shock-absorbing band 116, so as to be substantially parallel to the first reinforcement 112. Thus, the board 110, according to the seventh embodiment, has a sandwich-type structure.

Figure 11:
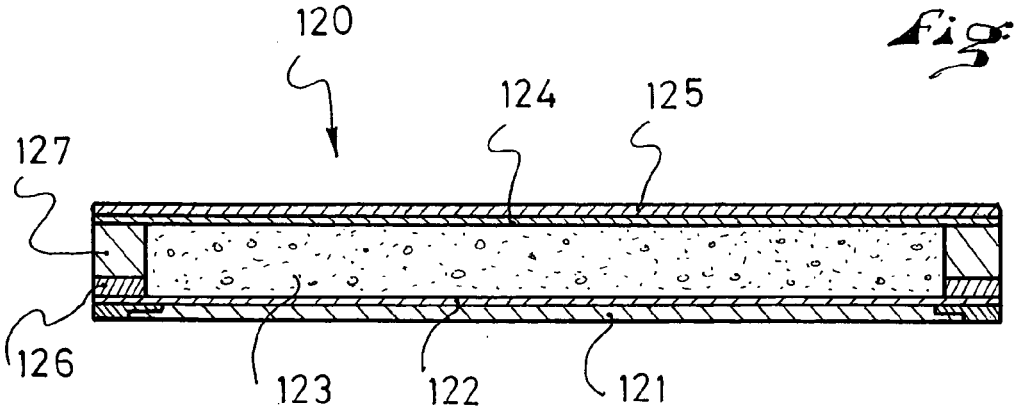
FIG. 11 is a cross-section similar to that of FIG. 10, for a sandwich-type board, according to an eighth embodiment of the invention.

The eighth embodiment is described with reference to FIG. 11.

A board 120 has, in height, a sole 121, a first reinforcement 122, a first core 123, a second reinforcement 124, and a protective layer 125. A shock-absorbing band 126 and a spacer 127 are arranged between the reinforcements 122, 124 at the periphery of the board 120. The shock-absorbing band 126 and the spacer 127 form a laminated stack whose thickness is substantially equal to that of the core 123 or, as shown in FIG. 11, a height that is equal to that of the core 123, particularly at the lateral edges of the core. The band 126 is arranged closer to the first reinforcement as compared to the spacer. But the opposite is possible. Here again, the second reinforcement 124 covers both the core 123 and the stacking, so as to be substantially parallel to the first reinforcement 122. Thus, the board 120, according to the eighth embodiment, has a sandwich-type structure.

For all of the examples, the invention is made from materials and according to embodiment techniques that are known to one skilled in the art.

The invention is not limited to the particulars of the embodiments described hereinabove, and it encompasses all of the equivalents that fall within the scope of the following claims.

In particular, a shock-absorbing band can be made of a plurality of different materials.

These materials can be distributed in the direction of the height and/or of the width and/or of the length of the band. The materials can also have different hardnesses.

A shock-absorbing band can be fragmented in that it has several portions that are juxtaposed, or non-juxtaposed. This allows optimizing the absorption of the vibrations along the periphery of the board.

The band can be inserted between the running edge and the first reinforcement. This promotes the shock-absorbing function.

What is claimed is:

1. A gliding or rolling board comprising:

a length measured along a longitudinal direction between a first end and a second end of the board, a width measured along a transverse direction between a first edge and a second edge, and a height measured between a gliding surface and a receiving surface;

along said height, the board includes a first reinforcement, a second reinforcement, and a first core positioned between said first reinforcement and said second reinforcement;

along said length, between the first end and the second end, the board includes a first end zone, a first transversely extending contact line, a central zone, a second transversely extending contact line, and a second end zone;

the board having a sandwich structure extending at least from the first contact line to the second contact line, said sandwich structure including the first reinforcement, the first core, and the second reinforcement, whereby said sandwich structure further comprises the second reinforcement extending widthwise substantially parallel to the first reinforcement in transverse cross section from a first edge of the second reinforcement above the shock-absorbing material of the band, to a second edge of the second reinforcement;

along at least a portion of an outer periphery of the board and at least from the first contact line to the second contact line, the board further including a band comprising a shock-absorbing material laterally juxtaposed to said core.

2. A board according to claim 1, wherein:

the band is positioned between said first and second reinforcements.

3. A board according to claim 1, wherein:

the band has a thickness that is less than or equal to 50% of a maximum thickness of the core.

4. A board according to claim 1, wherein:

the band extends continuously in an area of the periphery of the board, the band connecting the first and second reinforcements along an entirety of the periphery between front and rear contact lines of the board.

5. A board according to claim 1, wherein:

the band is a continuous element, without joints.

6. A board according to claim 1, wherein:

the band has a first lateral portion and a second lateral portion.

7. A board according to claim 1, wherein:

the band has a first end portion and a second end portion.

8. A board according to claim 1, wherein:

the band is relatively wide in the area of a first lateral edge, and relatively narrow in the area of a second lateral edge.

9. A board according to claim 1, further comprising:

a second core and a third reinforcement, and wherein a second shock-absorbing band is positioned between the second reinforcement and the third reinforcement at the outer periphery of the board or at a periphery of the second core.

10. A board according to claim 1, wherein:

the band has a rectangular cross-section.

11. A board according to claim 1, wherein:

the band has a thickness of between 0.2 millimeters and 5.0 millimeters.

12. A board according to claim 1, wherein:

the band has a width approximate to a width of a peripheral running edge of the board.

13. A board according to claim 1, wherein:

the band comprises rubber.

14. A board according to claim 1, wherein:

the shock-absorbing band has a height substantially identical to a height of the core.

15. A board according to claim 1, wherein:

the core comprises wood or a synthetic foam.

16. A board according to claim 1, wherein:

said first and second transversely extending contact lines are positioned on opposite longitudinal sides of foot-retaining zones.

17. A board according to claim 16, wherein:

said band comprises a first band on a first side of the board;

said board further comprises a second band on a second side of the board, said second band extending at least from said first transversely extending contact line to said second transversely extending contact line.

18. A board according to claim 17, wherein:

each of the first and second bands is a continuous element, without joints.

19. A board according to claim 1, wherein:

said first reinforcement and said second reinforcement are parallel in a transverse cross section from the first peripheral edge to the second peripheral edge.

20. A board according to claim 1, wherein:

said shock-absorbing material of said band is more flexible than acetyl-butadiene-styrene.

21. A board according to claim 20, wherein:

said shock-absorbing material of said band has a hardness of approximately 10 shore D.

22. A board according to claim 1, wherein:

said shock-absorbing material of said band has a hardness in a range between approximately 10 shore D and approximately 60 shore D.

23. A board according to claim 1, wherein:

the band has a thickness of between 0.2 millimeters and 5.0 millimeters.

24. A board according to claim 1, wherein:

said sandwich structure extends substantially along an entirety of the length of the board.

25. A gliding or rolling board comprising:

a length measured along a longitudinal direction between a first end and a second end of the board, a width measured along a transverse direction between a first edge and a second edge, and a height measured between a gliding surface and a receiving surface;

along said height, the board includes a first reinforcement, a second reinforcement, and a first core positioned between said first reinforcement and said second reinforcement;

along said length, between the first end and the second end, the board includes a first end zone, a first transversely extending contact line, a central zone, a second transversely extending contact line, and a second end zone;

the board having a sandwich structure extending at least from the first contact line to the second contact line, said sandwich structure including the first reinforcement, the first core, and the second reinforcement, whereby said sandwich structure further comprises the second reinforcement extending widthwise substantially parallel to the first reinforcement in transverse cross section from a first edge of the second reinforcement above the shock-absorbing material of the band, to a second edge of the second reinforcement;

along at least a portion of an outer periphery of the board and at least from the first contact line to the second contact line, the board further including a band comprising a shock-absorbing material laterally juxtaposed to said core, the band having a substantially constant thickness along an entirety of a length of the band.

26. A board according to claim 25, wherein:

said sandwich structure extends substantially along an entirety of the length of the board.

27. A gliding or rolling board comprising:

a length measured along a longitudinal direction between a first end and a second end of the board, a width measured along a transverse direction between a first edge and a second edge, and a height measured between a gliding surface and a receiving surface;

along said height, the board includes a first reinforcement, a second reinforcement, and at least a first core, said first core being positioned between said first reinforcement and said second reinforcement;

along said length, between the first end and the second end, the board includes a first end zone, a first transversely extending contact line, a central zone, a second transversely extending contact line and a second end zone;

along at least a portion of a periphery of the board, the board includes at least one band comprising a shock-absorbing material juxtaposed to at least one of said reinforcements and at least one spacer comprising a material other than said shock-absorbing material;

the board having a sandwich-type structure extending at least from the first contact line to the second contact line, said sandwich structure including the first reinforcement, the first core, and the second reinforcement, whereby:

the at least one band and the at least one spacer form a stacked structure having a thickness substantially equal to a thickness of the first core at a lateral edge of the first core;

the stacked structure formed by the at least one band and said at least one spacer is vertically above the first reinforcement and vertically beneath the second reinforcement, the second reinforcement covering both the first core and the stacked structure;

the second reinforcement being substantially parallel to the first reinforcement in transverse cross section from a first lateral edge of the second reinforcement above the stacked structure to a second lateral edge of the second reinforcement above the stacked structure.

28. A board according to claim 27, wherein:

only one spacer and only one band comprise said stacked structure.

29. A board according to claim 27, wherein:

said first reinforcement and said second reinforcement are parallel in a transverse cross section between the first peripheral edge to the second peripheral edge.

30. A board according to claim 27, wherein:

said shock-absorbing material of said band is more flexible than acetyl-butadiene-styrene.

31. A board according to claim 30, wherein:

said shock-absorbing material of said band has a hardness of approximately 10 shore D.

32. A board according to claim 27, wherein:

said shock-absorbing material of said band has a hardness in a range between approximately 10 shore D and approximately 60 shore D.

33. A board according to claim 27, wherein:

the band has a thickness of between 0.2 millimeters and 5.0 millimeters.

34. A board according to claim 27, wherein:

said sandwich structure extends substantially along an entirety of the length of the board.

35. A snowboard comprising:

a length measured along a longitudinal direction between a first end and a second end of the snowboard, a width measured along a transverse direction between a first peripheral edge and a second peripheral edge, and a height measured between a gliding surface and a receiving surface;

along said length, between the first end and the second end, the snowboard includes a first end zone, a zone for retaining a first foot, a central zone, a zone for retaining a second foot, and a second end zone, the snowboard further comprising a first transversely extending contact line and a second transversely extending contact line, said first and second transversely extending contact lines being longitudinally spaced apart and positioned on opposite longitudinal sides of the first and second foot-retaining zones;

along said height, the snowboard includes a first reinforcement, a second reinforcement, and a core positioned above said first reinforcement and below said second reinforcement;

at least from the first contact line to the second contact line, the second reinforcement being positioned above the first reinforcement at a substantially uniform height transversely from the first peripheral edge of the snowboard to the second peripheral edge of the snowboard;

along at least a portion of a periphery of the snowboard, the snowboard includes a band comprising a shock-absorbing material vertically above or below at least one of said reinforcements and laterally juxtaposed to said core;

the shock-absorbing material of said band extending at least from said first transversely extending contact line to said second transversely extending contact line.

36. A snowboard according to claim 35, wherein:

said band comprises a first band on a first side of the snowboard;

said snowboard further comprises a second band on a second side of the snowboard, said second band extending at least from said first transversely extending contact line to said second transversely extending contact line.

37. A snowboard according to claim 36, wherein:

each of the first and second bands is a continuous element, without joints.

38. A snowboard according to claim 35, wherein:

said second reinforcement extends widthwise substantially parallel to said first reinforcement in transverse cross section, from a point on a first side of a longitudinal center line of the snowboard above the shock-absorbing material of the band, to a second point on a second side of the longitudinal center line of the snowboard.

39. A snowboard according to claim 35, wherein:

said first reinforcement and said second reinforcement are parallel in a transverse cross section between the first peripheral edge to the second peripheral edge.

40. A snowboard according to claim 35, wherein:

said first reinforcement and said second reinforcement are parallel in a plurality of transverse cross sections along the length of the snowboard between the first peripheral edge to the second peripheral edge.

41. A snowboard according to claim 35, further comprising:

a spacer along at least a portion of the periphery of the snowboard;

the band and said spacer forming a stacked structure having a thickness equal to a thickness of the core at lateral edges of the core.

42. A snowboard according to claim 41, wherein:

only one spacer and only one band comprise said stacked structure.

43. A snowboard according to claim 35, wherein:

substantially along an entirety of the length of the board, the second reinforcement is positioned above the first reinforcement at a substantially uniform height transversely from the first peripheral edge of the snowboard to the second peripheral edge of the snowboard.

44. A gliding or rolling board comprising:

a length measured along a longitudinal direction between a first end and a second end of the board, a width measured along a transverse direction between a first edge and a second edge, and a height measured between a gliding surface and a receiving surface;

along said height, the board includes a first reinforcement, a second reinforcement, and at least one core, said core being positioned between said first reinforcement and said second reinforcement;

along said length, between the first end and the second end, the board includes a first end zone, a central zone, and a second end zone;

a first transversely extending contact line and a second transversely extending contact line, said first and second transversely extending contact lines being longitudinally spaced apart;

along at least a portion of a periphery of the board, the board includes at least one band comprising a shock-absorbing material juxtaposed to at least one of said reinforcements and at least one spacer comprising a material other than said shock-absorbing material;

the board having a sandwich structure extending substantially along an entirety of the length of the board, said sandwich structure comprising the first reinforcement, the first core, and the second reinforcement, whereby:

the at least one band and the at least one spacer form a stacked structure having a thickness equal to a thickness of the core at a lateral edge of the core;

the stacked structure formed by the at least one band and the at least one spacer being vertically above the first reinforcement and vertically beneath the second reinforcement, the second reinforcement covering both the core and the stacked structure;

the stacked structure extending longitudinally through a transversely extending vertical median plane of the board at least from the first contact line to the second contact line;

the second reinforcement being substantially parallel to the first reinforcement in transverse cross section from a first lateral edge of the second reinforcement above the stacked structure to a second lateral edge of the second reinforcement above the stacked structure.

45. A board according to claim 44, wherein:

said stacked structure comprises said first band on a first transverse side of the board and a second band on a second transverse side of the board.

46. A board according to claim 44, wherein:

said shock-absorbing material of said band is more flexible than acetyl-butadiene-styrene.

* * * * *